US005621950A

United States Patent [19]

White

[11] Patent Number: 5,621,950

[45] Date of Patent: Apr. 22, 1997

[54] SPRING BIASED PAPER CLIP

[76] Inventor: Marvin D. White, 175 Telegraph Rd., Stafford, Va. 22554

[21] Appl. No.: 562,549

[22] Filed: Nov. 24, 1995

[51] Int. Cl.[6] ..... B42F 1/02

[52] U.S. Cl. ..... 24/67.5; 24/67.11; 24/565; 24/566

[58] Field of Search ..... 24/67.5, 67.3, 24/67 R, 67.11, 567, 566, 565, 507

[56] References Cited

U.S. PATENT DOCUMENTS

| | | | |
|---|---|---|---|
| 392,394 | 11/1888 | Allderige | 24/67.5 |
| 608,092 | 7/1898 | Williams | 24/567 X |
| 1,053,725 | 2/1913 | Gates | 24/67.11 |
| 2,666,240 | 1/1954 | Maccaferri | 24/507 X |
| 2,827,719 | 3/1958 | Nairn | 24/67 R |
| 3,968,546 | 7/1976 | Seaborn et al. | 24/67.11 X |
| 4,014,077 | 3/1977 | Hitchcock et al. | 24/67.5 |
| 4,023,721 | 5/1977 | Erthein | 24/67.5 X |
| 4,763,389 | 8/1988 | Chang | 24/67.11 |
| 4,899,974 | 2/1990 | Wear et al. | 24/67.11 X |

*Primary Examiner*—Peter M. Cuomo
*Assistant Examiner*—Hanh V. Tran

[57] ABSTRACT

A spring-loaded paper clip has a pair of plate elements which are hingedly connected together and which are provided with raised projections to improve gripping force so that the clip can hold large quantities of paper together without slipping or shifting.

1 Claim, 3 Drawing Sheets

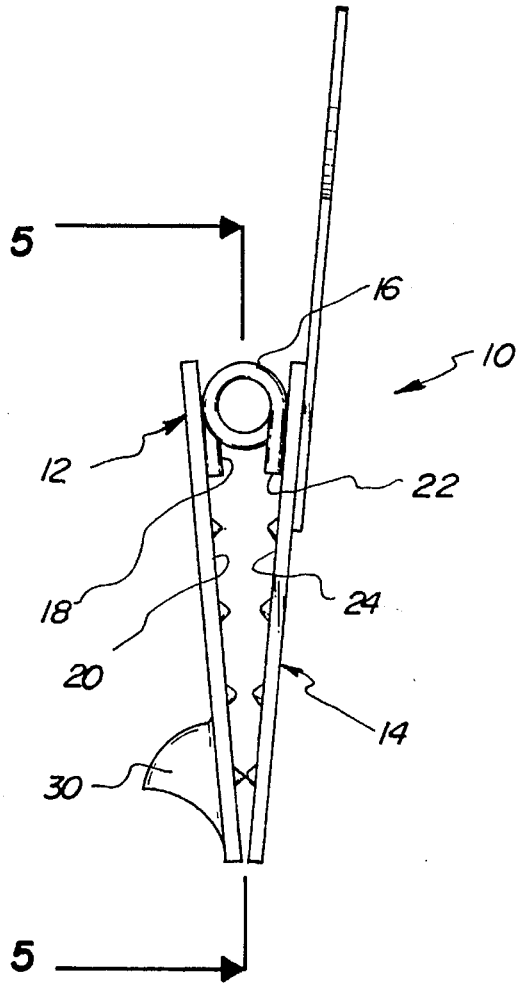
Fig. 3
Fig. 4
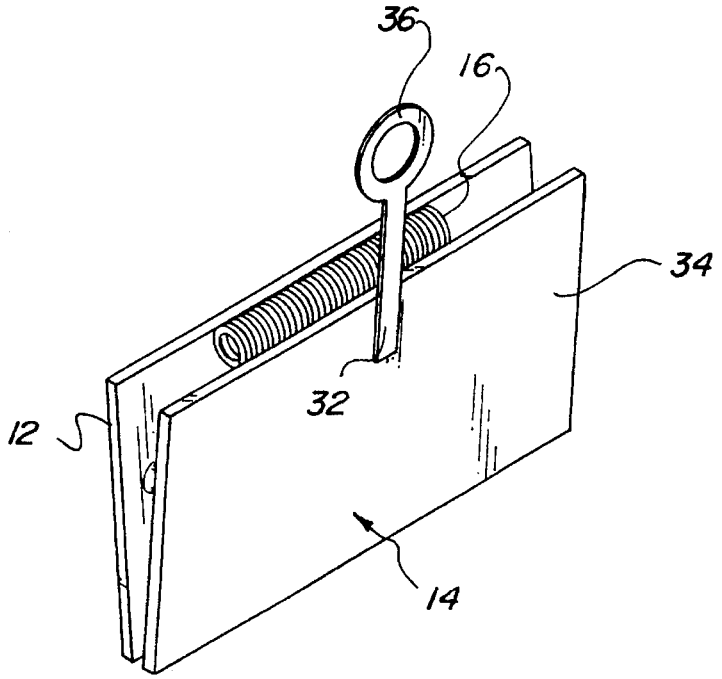

SPRING BIASED PAPER CLIP

BACKGROUND OF THE INVENTION

1. Field of the Invention

The present invention relates to paper clips and more particularly pertains to a spring-biased paper clip having improved opening means and paper gripping surfaces.

2. Description of the Prior Art

The use of various types of spring clips for holding sheets of paper together are well known in the prior art. For example, a representative embodiment of a spring clip formed from a single sheet of elastic metal plate is to be found in U.S. Pat. No. 5,309,605, which issued to Sato on May 10, 1994. Another example of this type of integral clip is to be found in U.S. Pat. No. 4,947,524, which issued to Chang on Aug. 14, 1990, wherein there is disclosed a paper clip formed from a single sheet of steel that has been bent into a U-shaped structure.

In addition to paper clips formed from a single sheet of material, there has been an effort to develop paper clips formed from a plurality of parts. An example of this type of multi-part paper clip is shown in U.S. Pat. No. 5,079,808, which issued to Brown on Jan. 14, 1992. The Brown Patent discloses a paper clip formed from a pair of plate elements having clamping edges and being hingedly connected together. A cantilever spring extends from an inner surface of one plate element and engages the inner surface of the opposite plate element, and the cantilever spring is utilized to provide an increasing clamping force with increasing document thickness. A plurality of ridges are provided on the clamping edges of the plates, and the ridges are designed to be parallely aligned and overlapping so as to achieve a better grip on documents retained between the plates.

While each of these prior art patents disclose paper gripping devices which fulfill their respective particular objectives and requirements, and are most likely quite functional for their intended purposes, it will be noted that none of the illustrated paper clips are particularly designed for holding large quantities of paper together through the use of specialized gripping surfaces, increased spring strength, and improved means for forcing paper engaging surfaces apart as would be necessary when utilizing a high tension spring. In this respect, the present invention substantially fulfills this need.

SUMMARY OF THE INVENTION

In view of the foregoing disadvantages inherent in the known types of paper clips now present in the prior art, the present invention provides a new paper clip wherein the same can be utilized to securely grip large quantifies of paper without a concern that the paper may slip or shift when retained by the clip. As such, the general purpose of the present invention, which will be described subsequently in greater detail, is to provide a paper clip and method which has many of the advantages of the paper clips mentioned heretofore and many additional novel features that result in a paper clip which is not anticipated, rendered obvious, suggested, or even implied by any of the prior art paper clips, either alone or in any combination thereof.

To attain this, the present invention generally comprises a spring-loaded paper clip which has a pair of plate elements which are hingedly connected together and which are provided with raised projections to improve gripping force so that the clip can hold large quantities of paper together without slipping or shifting.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paper clip and method which has many of the advantages of the paper clips mentioned heretofore and many novel features that result in a paper clip which is not anticipated, rendered obvious, suggested, or even implied by any of the prior art paper clips, either alone or in any combination thereof.

It is another object of the present invention to provide a new paper clip which may be easily and efficiently manufactured and marketed.

It is a further object of the present invention to provide a new paper clip which is of a durable and reliable construction.

An even further object of the present invention is to provide a new paper clip which is susceptible of a low cost of manufacture with regard to both materials and labor, and which accordingly is then susceptible of low prices of sale to the consuming public, thereby making such paper clip economically available to the buying public.

Still yet another object of the present invention is to provide a new paper clip which provides in the apparatuses and methods of the prior art some of the advantages thereof, while simultaneously overcoming some of the disadvantages normally associated therewith.

Still another object of the present invention is to provide a new and improved paper clip which facilitates the use of specialized gripping surfaces to hold large quantities of paper.

Yet another object of the present invention is to provide a new and improved paper clip which utilizes an enlarged tension spring along with special gripping means to facilitate the retention of a large quantity of paper together without a concern that the paper might slip or shift relative to the paper clip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an end elevation view of the invention.

FIG. 4 is a cross-sectional view of the invention as viewed along the line 4—4 in FIG. 2.

DESCRIPTION OF PREFERRED EMBODIMENTS

Figure 1:
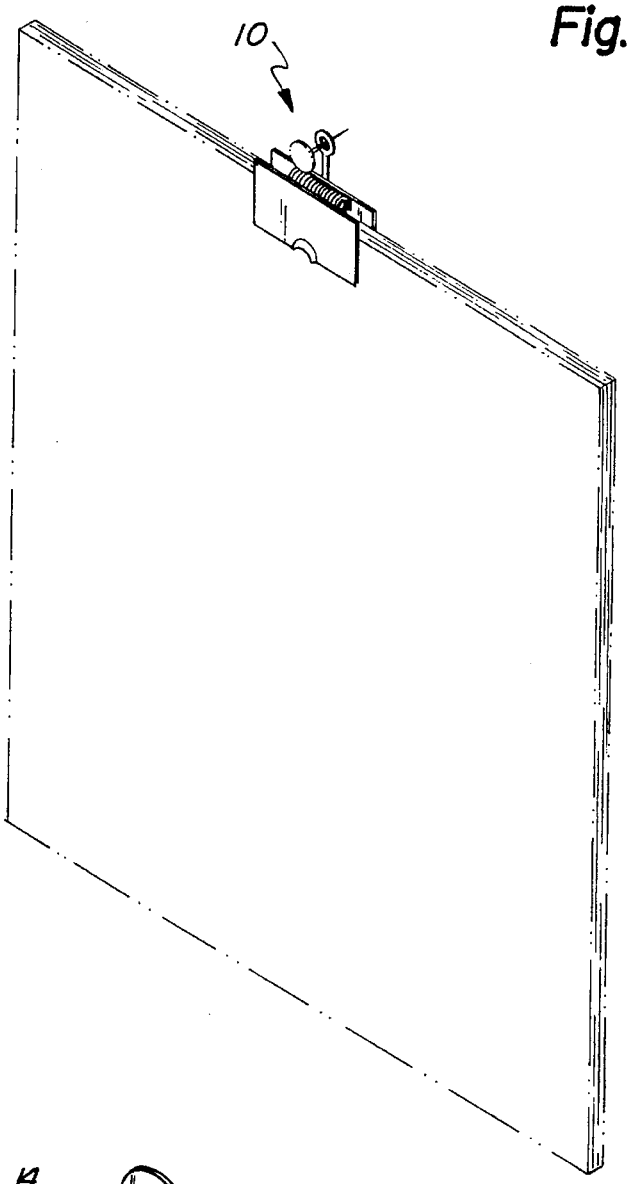
FIG. 1 a perspective view of the spring-loaded fastener comprising the present invention and showing the same being utilized to retain a quantity of paper together.
Figure 2:
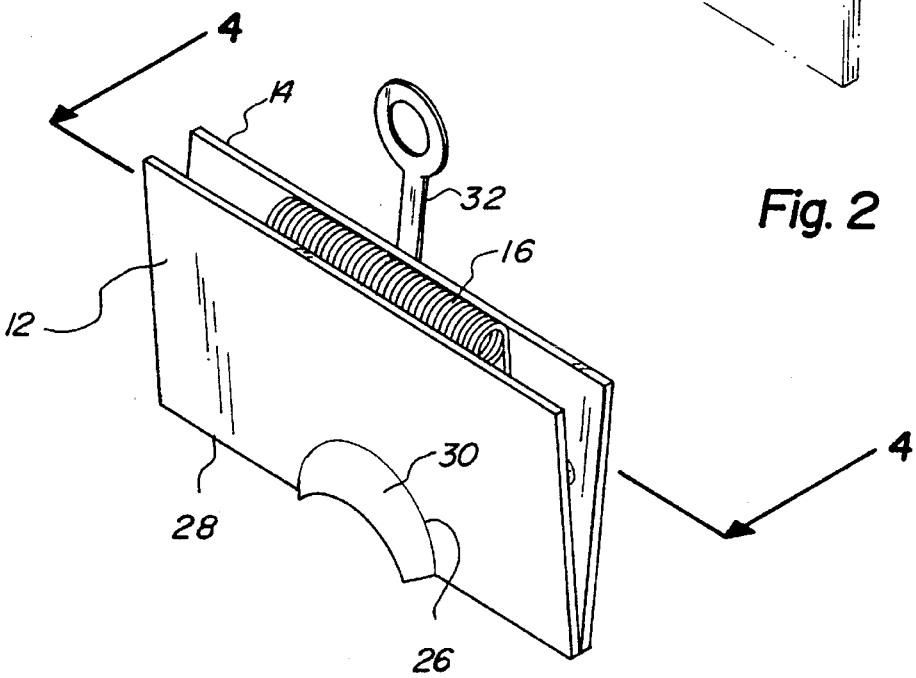
FIG. 2 is an enlarged perspective view of the invention.

With reference now to the drawings, and in particular to FIGS. 1–4 thereof, a new paper clip embodying the principles and concepts of the present invention and generally designated by the reference numeral 10 will be described.

More specifically, it will be noted that the paper clip 10 comprising the present invention essentially consists of a first rectangular plate 12 hingedly connected to a second rectangular plate 14 wherein the hinge consists of a tightly coiled and very rigid tension spring 16 positioned therebetween. As best illustrated in FIG. 3, one end 18 of the spring 16 is fixedly secured by some conventional means, such as by welding or the like, to an inner face 20 of the first plate 12, and the second remaining end 22 of the spring is similarly fixedly secured to an inner face 24 of the plate 14. The spring 16, in addition to functioning as a hinge, operates to retain the paper contacting faces 20, 24 of the respective plates 12, 14 in a close abutting relationship.

Normally, a pair of plates 12, 14 retained together by a tension spring 16 could be forced apart by applying a squeezing or compressive force along top edges of the plates at the opposed ends of the spring. However, inasmuch as the spring 16 is of a substantially strong design in the present invention 10, the first plate 12 is provided with a curvilinear cut-out 26 along a bottom edge 28 thereof, and an upstanding concavely-shaped finger grip 30 is permanently, fixedly secured around the edge of the cut-out. As best illustrated in FIG. 3, the finger grip 30 is particularly well shaped to receive the end of a user's finger so as to serve as a first gripping means to assist the user in forcing the plates 12, 14 apart against the retaining force provided by the spring 16. Of course, as will be readily understood, when a user is employing the use of the finger member 30 to force the plates 12, 14 apart, he will be holding the second plate 14 between the fingers of his opposite hand or otherwise, the finger member 30 would not be functionally usable.

The paper clip 10 further includes a hanging means in the form of an elongated member 32 fixedly attached by some conventional means to a rear surface 34 of the plate 14. Typically, the hanging member 32 would be of a strong metallic construction and could be conventionally welded to the rear surface 34 of the plate 14. In its preferred form, the hanging member 32 will be provided with a closed loop 36 at a top end thereof whereby a tack or some similar type of fastener could be utilized to fasten the paper clip 10 to a vertical support surface, such as a wall, bulletin board, or the like.

Figure 5:
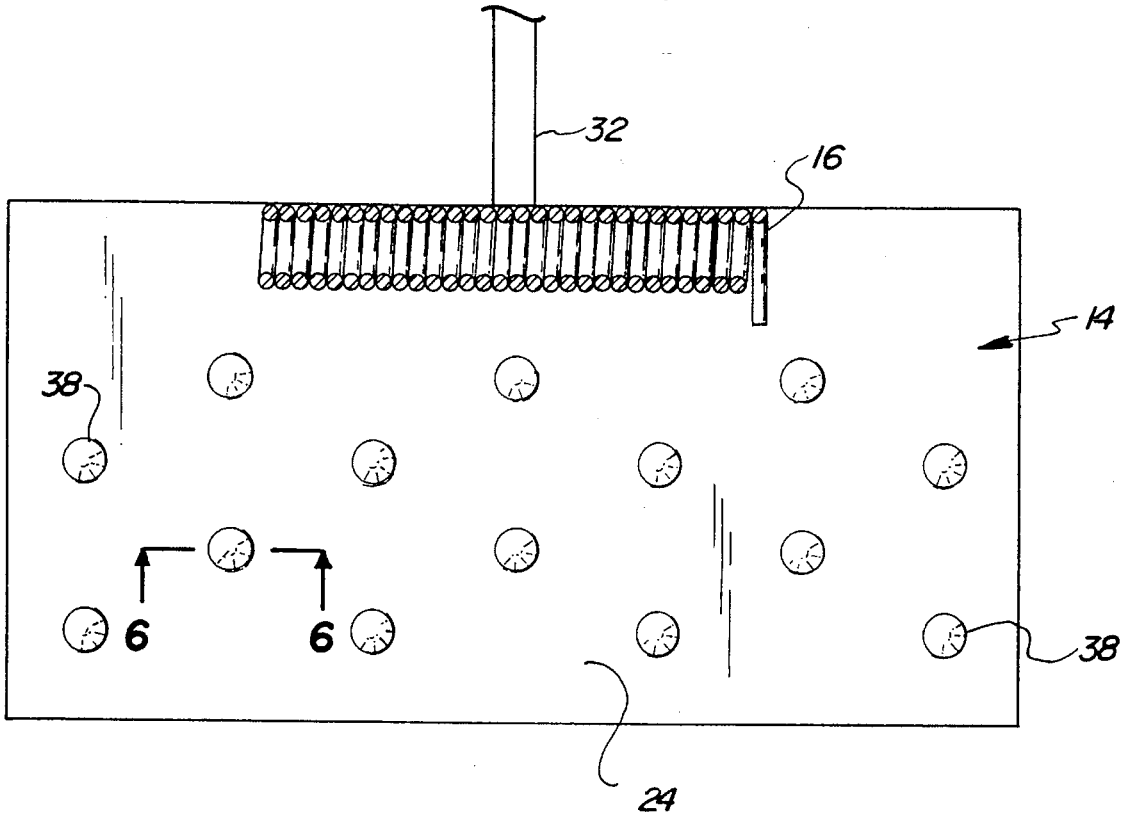
FIG. 5 is a cross-sectional view of the invention as viewed along the line 5—5 of FIG. 3.
Figure 6:
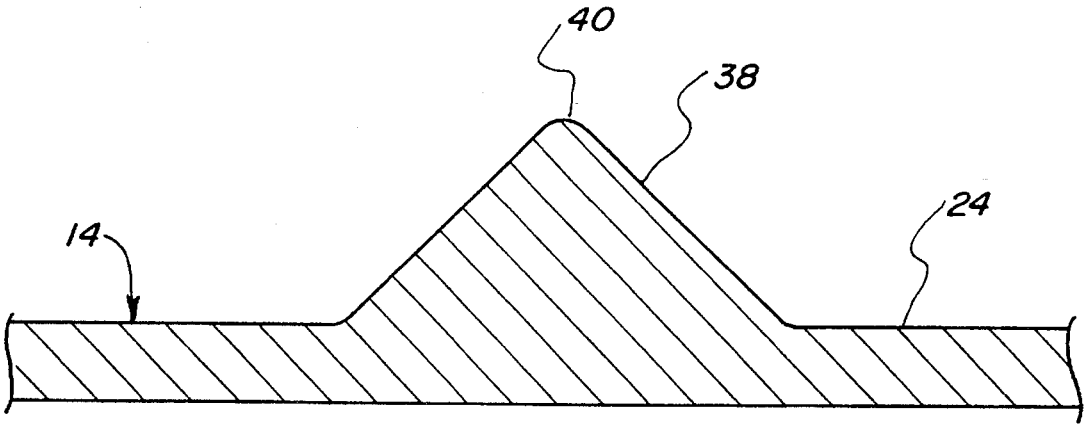
FIG. 6 is a cross-sectional view of the invention as viewed along the line 6—6 in FIG. 5.

To improve the gripping force and paper retaining capability of the contact faces 20, 24 of the respective plates 12, 14, a series of opposed protrusions, arranged in staggered rows and columns each of which is generally designated by the reference numeral 38, are integrally formed on the opposed paper contacting faces of the plates. As shown in FIGS. 5 and 6, each protrusion 38 is essentially formed as a cone having a smooth curvilinearly shaped apex 40. Depending upon their alignment on the opposed faces 20, 24 of the respective plates 12, 14, the cones can be caused to overlap with spaces therebetween, or they can be aligned to bring their opposed apexes 40 into an abuttable engagement. In the preferred embodiment, the apexes 40 will abut together, as best illustrated in FIG. 3, so as to provide pinpoint, strong compressive forces for holding a large quantity of paper together between the plates 12, 14, without an undue amount of compressive damage to the papers. At most, only a plurality of pinpoint indentations will be visible upon the quantifies of paper held together upon their removal from between the plates 12, 14, thereby minimizing the amount of aesthetic and other damage to the paper.

While in the preferred embodiment, the apexes 40 of opposed protrusions 38 will be abuttable together with the curvilinear shape of each apex preventing holes from being punctured in the paper, it is also within the intent and purview of the present invention to have the outer peripheral surfaces of opposed protrusions 38 to be aligned in an engaging manner, provided that the plate contact surfaces 20, 24 could be brought into a flush abutting relationship. While this could cause a greater amount of aesthetic damage to the paper held together, it could provide an increased gripping force in certain situations. Therefore, all variations of alignments available to the opposed protrusions 38 are intended to be encompassed by the claims appended hereto. As such, the paper clip 10 comprising the present invention provides the holding power of a large fastener with the ease of a paper clip. The flat plates 12, 14 prevent marks in the paper while the protrusions 38 hold the entire pile of paper tightly. This fastener 10 can accommodate heavy gauge paper which often breaks standard fasteners, and the tension spring 16 in the hinge provides control without adding extra weight to the device. It is perfect for large documents that must be displayed on a bulletin board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved spring-loaded fastener for holding a large quantity of paper together, the apparatus adapted for use in association with a large quantity of paper together, the apparatus adapted for use in association with a large quantity of paper, said spring loaded fastener comprising:

a first rectangular plate having a long width and a short height and having an upper end and a lower end and further having an inner face and an outer face;

a second rectangular plate having a long width and a short height and having an upper end and a lower end and further having an inner face and an outer face a tension spring with a first end and a second end, said tension spring being connected to said first plate and said second plate with the first end secured to the inner face of the first plate adjacent to the upper end thereof and the second end secured to the inner face of the second plate adjacent to the upper end thereof, said tension spring providing a substantial closing force between said first and second plates, thereby to normally keep first and second plates in an abutting relationship at lower ends thereof;

first gripping means for permitting a user to efficiently grip and force apart said first and second plates, whereby a large quantity of paper can be positioned between said first and second plates, the large quantity of paper being firmly gripped and retained between said first and second plates upon release of said first gripping means by a user of said fastener;

second gripping means formed on opposed paper contacting faces of said first and second plates; and said second gripping means comprising a plurality of staggered rows and columns of raised protrusions on the majority of inner faces of each of said opposed paper contacting faces of said first and second plates, said protrusions on each face being engageable with said large quantity of paper, said raised protrusions being formed in a generally conical shape with a curvilinearly shape apex;

said protrusions on said first plate aligned and abuttable with said protrusions on said second plate, thereby to provide an increased gripping force between said first and second plates at a point of contact between said protrusions;

said first gripping means comprising a raised finger receiving surface on said first plate, whereby a finger of said user can be inserted therein to apply an opening force between said first and second plates; and hanging means attached to the outer face of said second plate, said hanging means having a top end formed as a closed loop for facilitating an attachment of said fastener to a substantially vertical support surface, thereby to permit an accessible displaying of the large quantity of paper when the large quantity of paper is retained between said first and second plates.

* * * * *